US005499847A

United States Patent [19]

Smith

[11] Patent Number: 5,499,847

[45] Date of Patent: Mar. 19, 1996

[54] HARDBACK BOOKS

[76] Inventor: Charles P. Smith, The Book House, Yatton Keynell, Chippenham, Wiltshire, England, SN14 7BH

[21] Appl. No.: 257,692

[22] Filed: Jun. 6, 1994

[30] Foreign Application Priority Data

Jun. 10, 1993 [GB] United Kingdom ..... 9312009

[51] Int. Cl.[6] ..... B42D 3/00

[52] U.S. Cl. ..... 281/37; 281/29; 281/36; 281/40

[58] Field of Search ..... 281/15.1, 21.1, 281/40, 51, 29, 36, 37; 402/70, 73, 80 R

[56] References Cited

U.S. PATENT DOCUMENTS

| | | | |
|---|---|---|---|
| 1,805,314 | 5/1931 | Morton | 281/36 |
| 3,527,632 | 9/1970 | Holes et al. | 281/29 X |
| 4,019,823 | 4/1977 | Kleinert et al. | 281/29 X |
| 5,108,130 | 4/1992 | Hansen . | |
| 5,207,456 | 5/1993 | Donhoff | 281/40 |

FOREIGN PATENT DOCUMENTS

| | | | |
|---|---|---|---|
| 664740 | 9/1929 | France | 281/37 |

*Primary Examiner*—Willmon Fridie, Jr.
*Attorney, Agent, or Firm*—Young & Thompson

[57] ABSTRACT

A hardback book comprises a plurality of leaves connected together at the rear of the book so as to form a spine, and two rigid or semi-rigid cover boards covering the front and back leaves respectively. Each cover board projects rearwardly beyond the spine of the book when the book is closed and, preferably, beyond the edge of the spine by a distance which is approximately half the distance between the two longitudinal edges of the spine when the book is fully opened at its center on a flat surface.

17 Claims, 4 Drawing Sheets

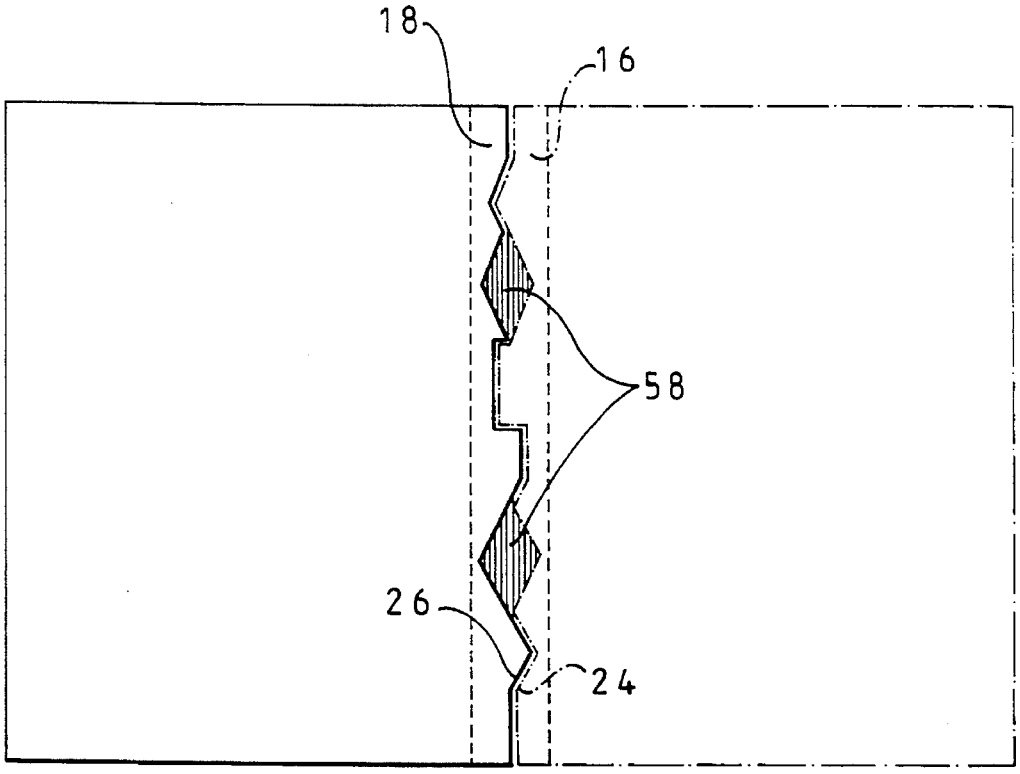
FIG 8
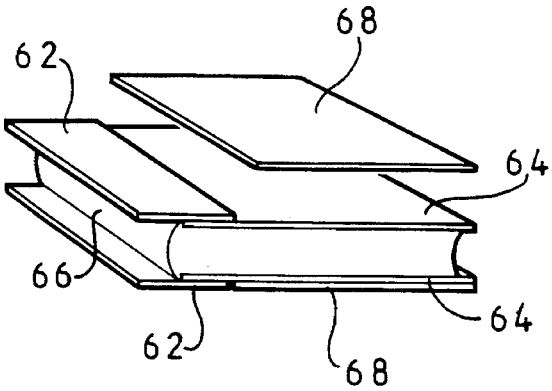
FIG 10
FIG 9
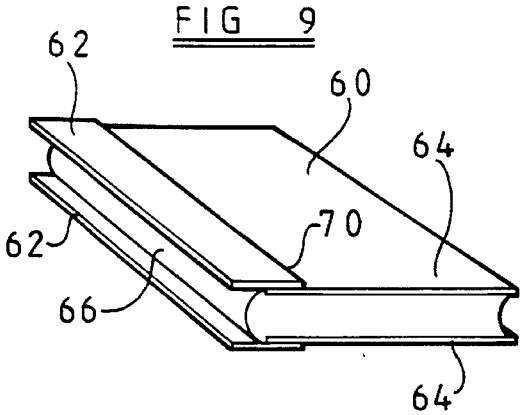

HARDBACK BOOKS

FIELD OF THE INVENTION

BACKGROUND OF THE INVENTION

Hardback books usually comprise a pair of rigid or semi-rigid planar cover boards which, when the book is closed, cover the front and back leaves of the book respectively. Usually, the book comprises a plurality of sections, sometimes called signatures, gatherings or bundles, each section comprising a plurality of leaves. The sections are connected together at the rear of the book so as to form a spine. The leaves of each section are folded along a fold-line which extends along the spine of the book. The sections may be held together by any combination of glue, guards, and stitching. In addition, binding cords or tapes may be provided, each binding cord extending laterally across the spine in order to provide the spine with additional strength and rigidity, and as a sewing support.

The two cover boards are effectively hinged to the leaves of the book about two axes extending along the two longitudinal edges of the spine. For example, the cover boards may be attached to the guards attached to the front and back sections of the book so as to form cover hinges along the front and back edges of the spine. The cover boards are typically covered with a protective covering material which extends between the two cover boards across the spine of the book so as to form a spine covering. The spine covering is not usually attached to the spine of the book, but nevertheless prevents easy access to the rear edges of the sections. In some cases, particularly in hand-bound styles, under-linings or coverings of acid-free material may be directly attached to the spine folds. This can make it particularly difficult to restore the book, since the sections of the book cannot easily be separated and re-connected. The ease with which a book can be taken apart in order to allow restoration is known in the art as reversibility. It will therefore be seen that the known hardback books described above are not particularly reversible.

A further problem with the known hardback books described above is that, because the spine covering can come into contact with the spine of the book, there is a tendency for acid to migrate through the spine covering and attack the spine. The acid can increase the rate of deterioration of the sewing and sections, and the problem is particularly noticeable in the case of flexible leather spine coverings.

The invention seeks to overcome the disadvantages of the prior art.

SUMMARY OF THE INVENTION

According to the invention there is provided a hardback book comprising a plurality of leaves connected together at the rear of the book so as to form a spine, and two rigid or semi-rigid cover boards covering the front and back leaves respectively, wherein each cover board projects rearwardly beyond the spine of the book when the book is closed.

It will be appreciated that the projecting portions of the cover boards provide protection for the spine of the book. This gives a two-fold advantage. Firstly, because the spine of the book is protected against abrasion by the projecting portions of the cover boards there is no need, provided that the cover boards project sufficiently far beyond the spine of the book, for the book to be provided with a spine covering. This allows easy access to the spine of the book, and increases the reversibility of the book. Secondly, if the book is not provided with a spine covering, it will be appreciated that the spine of the book is less vulnerable to attack by acid, since the spine of the book is not in contact with material through which acid can migrate.

Also the projecting portions of the cover boards limit the extent to which the cover boards can be flexed back thus preventing the cover boards being flexed back so much that they could be broken off at the hinge.

Many books have spines which, for one reason or another, are not completely flat. For example, the spine of the book may be provided with stitching or binding cords which project rearwardly. Furthermore, many books have convex rounded spines when closed.

Preferably, if the spine of the book is not completely flat when the book is closed, the cover boards project at least beyond the rearmost part of the spine.

This feature ensures that the whole of the spine is protected by the cover boards from abrasion and damage.

Preferably, each cover board projects beyond the edge of the spine by a distance which is approximately half the distance between the two longitudinal edges of the spine when the book is fully opened at its center on a flat surface.

It will be appreciated that, in this case, the rear edges of the cover boards meet, or almost meet, one another when the book is fully opened at its center. This ensures that the cover boards provide the maximum degree of protection to the spine, while still allowing the book to be fully opened. When the book is opened at non-central leaves the rear edge of one of the cover boards will of course tend to lie above the rear edge of the other cover board.

Ideally, the cover boards are arranged such that the rear edges of the cover boards touch, or lie closely adjacent to, each other along all or most of the length of the spine when the book is fully opened at its center on a flat surface.

The rear edges of the cover boards need not be straight, and the distance by which each cover board projects beyond the spine may vary along the length of the spine.

For example, if the spine has rearwardly projecting parts such as binding cords or stitching, the rear edges of the cover boards may be formed with one or more recesses adapted to receive said rearwardly projecting parts when the book is opened.

This feature allows the cover boards of the book to be opened as far as possible without causing damage to the book as a result of forces arising from contact of the rear edges of the cover boards with said rearwardly projecting parts.

The depth of the or each recess may vary across the area of the recess, in order to match the shape of the or each of said projecting parts of the spine.

Preferably, the rear edge of one of the cover boards is of complementary shape to the rear edge of the other cover board, so that the two rear edges fit together when the book is fully opened at its center on a flat surface.

In this case, the two rear edges of the cover boards may be of complementary shape along the whole length of the spine, so that the two cover boards fit together to form a continuous surface when the book is fully opened at its center on a flat surface.

The portion of each cover board extending beyond the spine of the book is preferably integral with the rest of the cover board, but may alternatively be attached thereto.

It will be appreciated that the latter feature enables additional protection to be provided to the spines of existing books having spine coverings, which may or may not be removed.

In any of the above embodiments, the spine may be provided with a spine covering, lining, or stiffener.

This may be necessary for limiting twist or torque in the book block, and for giving measured flexibility.

The invention will now be more particularly described, by way of example only, with reference to the accompanying drawings.

BRIEF DESCRIPTION OF THE DRAWINGS

FIG. 8 shows another book the cover boards of which have partially complementary shaped rear edges;

FIG. 9 is a perspective view of a further book having separately attached rearwardly projecting protective strips; and FIG. 10 shows the book of FIG. 9 provided with additional filling boards.

DESCRIPTION OF THE PREFERRED EMBODIMENTS

Figure 1:
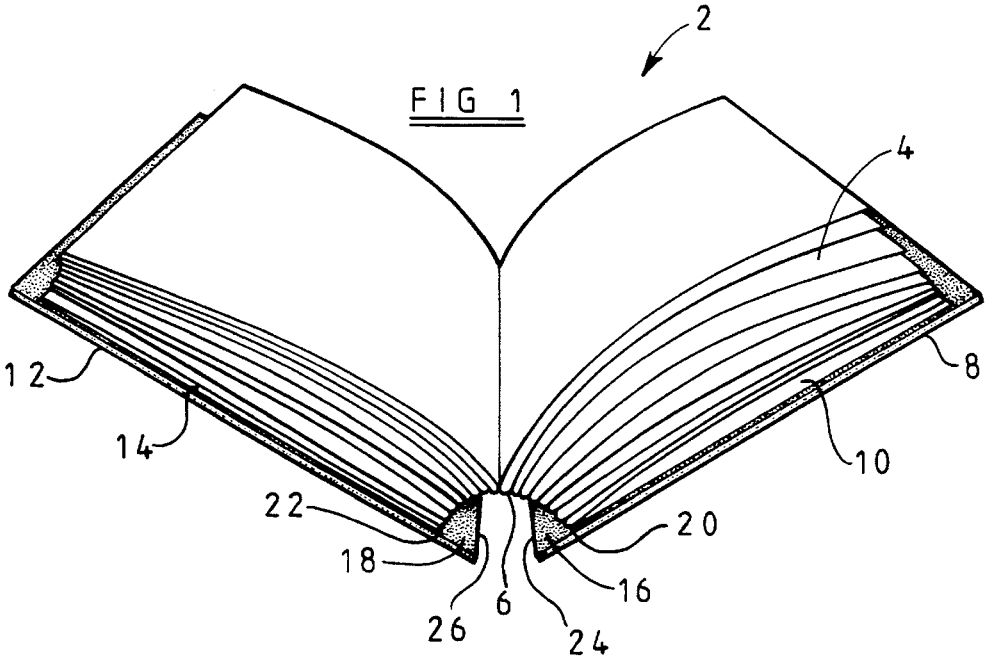
FIG. 1 is a perspective view of a hard back book which is partially opened at its center.

Referring to FIG. 1, a book 2 comprises a plurality of leaves 4 which are connected together at the rear of the book so as to form a flexible spine 6. The book also comprises a back cover board 8 covering the back leaf 10 of the book, and a front cover board 12 covering the front leaf 14 of the book. The book is shown partially opened at its center. The back cover board 8 comprises a rearwardly projecting portion 16 which projects beyond the spine 6 of the book. Similarly, the front cover board 12 comprises a rearwardly projecting portion 18 which projects beyond the spine 6 of the book to the same degree as the portion 16. The rearwardly projecting portions 16 and 18 provide protection for the spine 6 of the book, and also allow a spine covering to be dispensed with.

Figure 2:
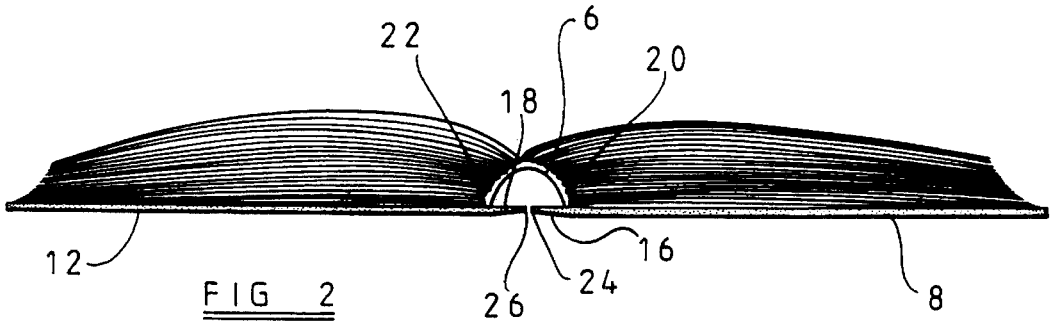
FIG. 2 is an end view of the front of the book, the book being opened at its center and lying on a flat surface.

FIG. 2 shows the book opened at its center on a flat surface so that the spine 6 of the book arches in a concave manner. It will be seen that the rearwardly projecting portions 16 and 18 each project beyond the spine 6 by an amount which is approximately equal to the natural separation between the back and front longitudinal edges 20 and 22 of the spine 6. This ensures that the rear edges 24 and 26 of the back and front cover boards 8 and 10 respectively lie closely adjacent to one another when the book is fully opened at its center, as shown in FIG. 2.

Figure 3:
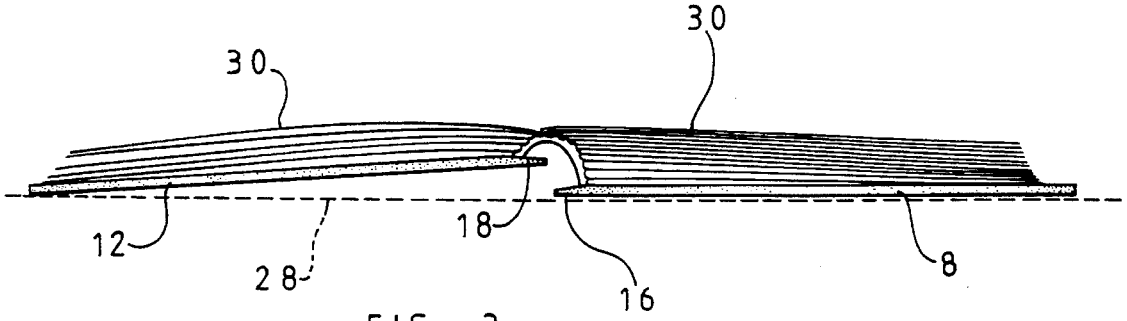
FIG. 3 is the same view as FIG. 2, with the book opened at non-central leaves.

As shown in FIG. 3, when the book is opened on a flat surface 28 at non-central leaves 30, the rearwardly projecting portion 18 of the front cover board 12 lies above the rearwardly projecting portion 16 of the back cover board 8, or vice versa.

Figure 4:
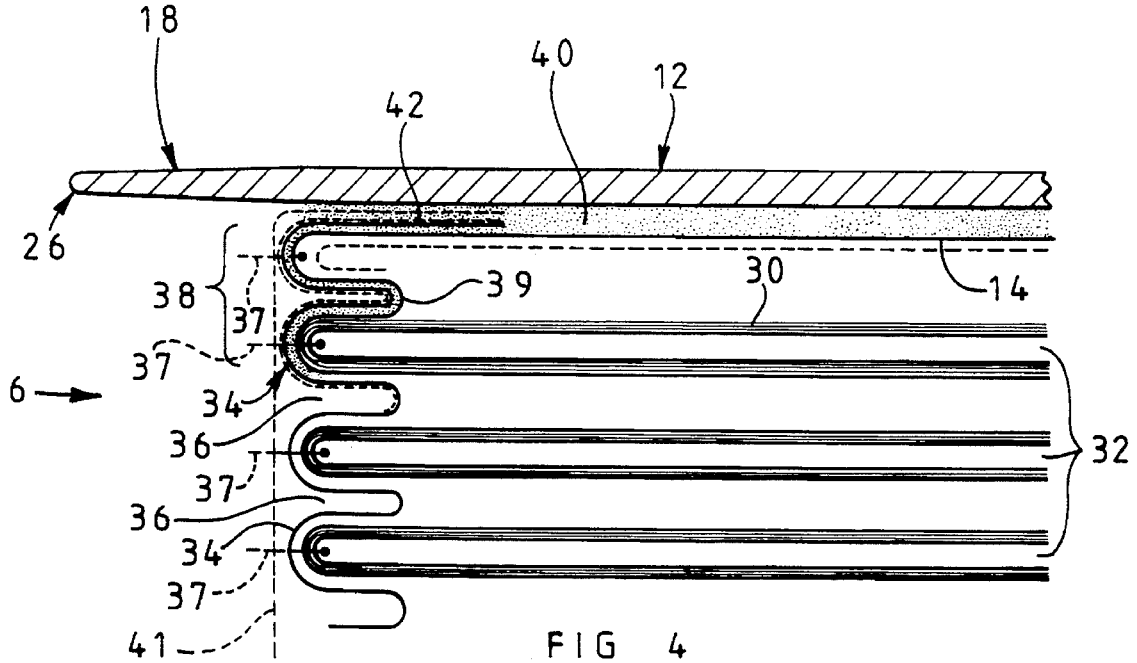
FIG. 4 is a sectional, expanded, view through a portion of the front part of the book when the book is closed.

FIG. 4 is a sectional, expanded, view through the frontmost three sections 32 of the book when the book is closed. The endmost sections are arranged in similar fashion. The sections are held together at the spine 6 by means of reinforcing fabric guards 34, together with adhesive 36 between the adjacent sections 32, and sewing (shown schematically by broken lines 37) to a sewing support 41. The front leaf 14 of the book includes a central V-shaped fold which forms a gusset 39. The reinforcing fabric guard 34 of the uppermost section is attached to the gusset 39 by adhesive. The uppermost section 38 is attached to the front cover board 12 by means of a layer of adhesive 40, together with an extended portion 42 of the guard 34. The leaves 30 of the uppermost section 38 are provided below the gusset 39 and sewn to a sewing support 41. The gusset prevents the first leaves of the book dragging open when the coverboard is opened.

It will be seen from FIG. 4 that the front cover board tapers towards its rear edge 26 to accommodate the swelling in the body of the book towards the spine because of additional sewing or guarding material 34. The rear edge 26 of the board may be rounded or bevelled on the inside edge. This tapering or shaping of the front cover board 12 allows the front cover board 12 to be opened further than would otherwise be possible, in view of the fact that the front cover board 12 can be opened further before the rear edge 26 comes into contact with the spine 6. The back cover board 8 is similarly tapered.

Figure 5:
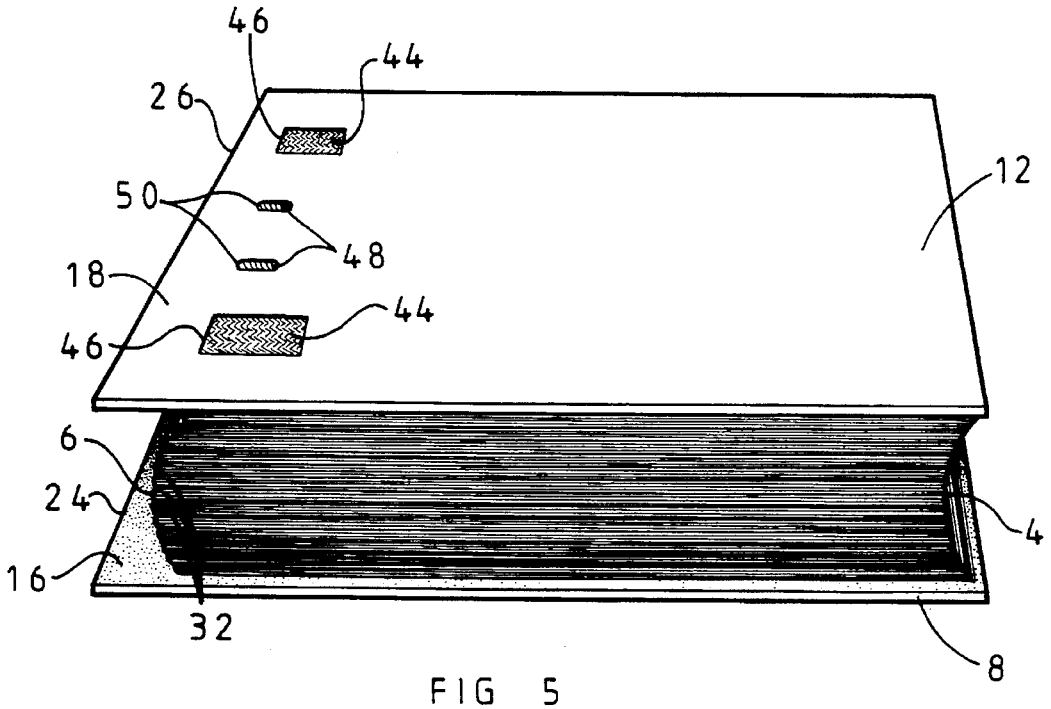
FIG. 5 is a perspective view of a book in its closed position.

FIG. 5 shows an alternative method of board attachment. The spine 6 is slightly rounded when the book is closed due to the sewing and guarding material 34. Two tapes 44 extend laterally across the spine 6 and through slots 46 in the cover boards 12 and 8. The tapes 44 provide support for stitching which extends across the spine 6 and holds the sections 32 of leaves 4 together. The tapes 44 are, for example, glued to the outer surfaces of the cover boards 8 and 12 to provide extra strength. Similarly, two raised bands or cords 48 extend laterally across the spine 6, pass through holes 50 in the cover boards, and are also secured to the outer surfaces of the cover boards 8 and 12.

Figure 6:
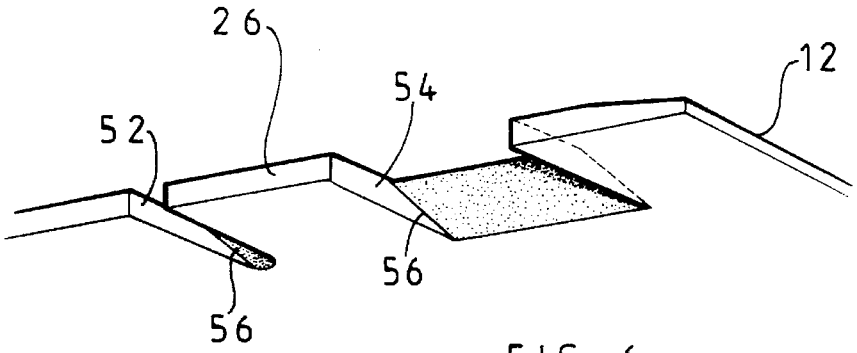
FIG. 6 is a perspective view of an alternative embodiment of part of the rear edge of the front cover board of the book.

It will be appreciated that when the book is opened, the rear edges 24 and 26 of the cover boards 8 and 12 may come into contact with the tapes 44 or bands 48, thus impeding the opening of the book, and possibly causing damage if the cover boards 8 and 12 are opened too far. In order to avoid this problem, the rear edges 24 and 26 of the cover boards may be provided with recesses as shown in FIG. 6. FIG. 6 shows part of the rear edge 26 of the front cover board 12, as seen from the underside of cover board 12. The rear edge 26 is provided with two slots 52 (only one of which is shown in FIG. 6) for receiving the two bands 48 when the cover board 12 is fully opened. Similarly, two rectangular recesses 54 (only one of which is shown in FIG. 6) are provided in the rear edge 26 for receiving the two tapes 44. As shown in FIG. 6, the slots 52 and recesses 54 are formed with tapered portions 56 which fit neatly with the bands 48 and tapes 44 when the cover board 12 is opened. The lower cover board 8 is provided with corresponding slots and recesses.

Figure 7:
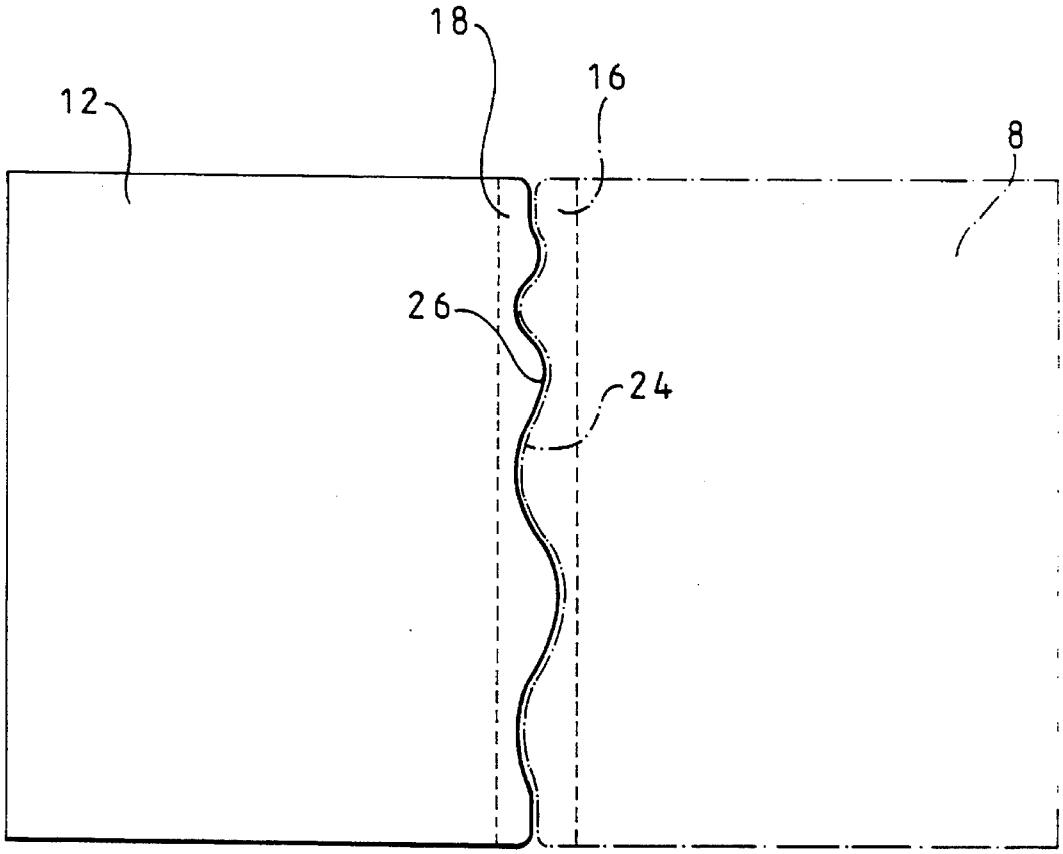
FIG. 7 is a view of a further book having cover boards with complementary shaped rear edges, the book being shown in its fully open position.

FIGS. 7 and 8 show further embodiments of the invention in which the rear edges 24 and 26 of the back and front cover boards 8 and 12 respectively are of complementary shape so as to fit together when the book is fully opened. The rear edges 24 and 26 are shaped in a curved wavy pattern in the embodiment of FIG. 7, and in a jagged angular pattern in the embodiment of FIG. 8. Furthermore, in FIG. 8, the rear edges 24 and 26 are shaped so as to provide spaces 58 at two positions along the length of the spine 6 when the book is opened. The spaces 58 may be of any shape or configuration and may be used to show a title label glued across the exposed area of the spine 6.

FIGS. 9 and 10 show how an ordinary hardback book 60 can be modified by attaching, for example using glue, two rigid strips 62 along the rear edges of the cover boards 64. The rigid strips 62 project rearwardly beyond the spine 66 of the book in order to protect the spine 66 from abrasion and damage. If desired, filling boards 68 can be attached to the cover boards 64 adjacent the strips 62 in order to remove the step 70 on the outside of the book caused by the rigid strips 62. The step 70 may also be sloped or tapered, as may any of the other board edges.

The above embodiments are given by way of example only and various modifications will be apparent to persons skilled in the art without departing from the scope of the invention as defined by the appended claims. In particular, there are many ways of holding leaves or sections together to form book blocks and these include non-adhesive methods and combinations of adhesive and sewing (with or without guards).

What is claimed is:

1. A hardback book comprising a plurality of leaves connected together at the rear of the book so as to form a spine, and two rigid or semi-rigid cover boards rigidly secured to, and covering the front and back leaves respectively, wherein each cover board has a rear edge and projects rearwardly beyond the spine of the book when the book is closed and wherein the spine has two longitudinal edges, and each cover board projects beyond a longitudinal edge of the spine by a distance, which is approximately half the distance between the two longitudinal edges of the spine when the book is fully opened at its center on a flat surface.

2. A hardback book as claimed in claim 1, wherein the spine of the book is not completely flat when the book is closed and wherein the cover boards project at least beyond a rearmost part of the spine.

3. A hardback book as claimed in claim 1, wherein the cover boards are arranged such that the rear edges of the cover boards touch, or lie closely adjacent to, each other along all or most of the length of the spine when the book is fully opened at its center on a flat surface.

4. A hardback book as claimed in claim 1, wherein the rear edges of the cover are rectilinear.

5. A hardback book as claimed in claim 4, wherein the spine has rearwardly projecting parts, and the rear edges of the cover boards are formed with one or more recesses adapted to receive said rearwardly projecting parts when the book is opened.

6. A hardback book as claimed in claim 5, wherein the depth of the or each recess varies across the area of the recess in order to match the shape of the or each of said projecting parts of the spine.

7. A hardback book comprising a plurality of leaves connected together at the rear of the book so as to form a spine, and two rigid or semi-rigid cover boards rigidly secured to, and covering the front and back leaves respectively, wherein each cover board has a rear edge and projects rearwardly beyond the spine of the book when the book is closed and wherein the rear edges of the cover boards are non-rectilinear and the distance by which each cover board projects beyond the spine varies along the length of the spine.

8. A hardback book as claimed in claim 7, wherein the spine has rearwardly projecting parts, and the rear edges of the cover boards are formed with one or more recesses adapted to receive said rearwardly projecting parts when the book is opened.

9. A hardback book as claimed in claim 8, wherein the depth of the or each recess varies across the area of the recess in order to match the shape of the or each of said projecting parts of the spine.

10. A hardback book as claimed in claim 7, wherein the rear edge of one of the cover boards is of complementary shape to the rear edge of the other cover board so that the two rear edges fit together when the book is fully opened at its center on a flat surface.

11. A hardback book as claimed in claim 1, wherein the portion of each cover board extending beyond the spine of the book is integral with the rest of the cover board.

12. A hardback book as claimed in claim 1, wherein the portion of each cover board extending beyond the spine of the book is attached to the rest of the cover board.

13. A hardback book as claimed in claim 1, wherein the spine is provided with a spine covering, lining or stiffener.

14. A hardback book as claimed in claim 7, wherein the spine of the book is not completely flat when the book is closed and wherein the cover boards project at least beyond a rearmost part of the spine.

15. A hardback book as claimed in claim 7, wherein the portion of each cover board extending beyond the spine of the book is integral with the rest of the cover board.

16. A hardback book as claimed in claim 7, wherein the portion of each cover board extending beyond the spine of the book is attached to the rest of the cover board.

17. A hardback book as claimed in claim 7, wherein the spine is provided with a spine covering, lining or stiffener.

* * * * *